US011230408B2

(12) United States Patent
Benkö et al.

(10) Patent No.: US 11,230,408 B2
(45) Date of Patent: Jan. 25, 2022

(54) SHEET PACKAGING MATERIAL FOR PRODUCING SEALED PACKAGES OF POURABLE FOOD PRODUCTS

(71) Applicant: Tetra Laval Holdings & Finance S.A., Pully (CH)

(72) Inventors: Gabor Benkö, Lund (SE); Niclas Björup, Genarp (SE)

(73) Assignee: Tetra Laval Holdings & Finance S.A., Pully (CH)

( * ) Notice: Subject to any disclaimer, the term of this patent is extended or adjusted under 35 U.S.C. 154(b) by 59 days.

(21) Appl. No.: 16/312,668

(22) PCT Filed: Jun. 21, 2017

(86) PCT No.: PCT/EP2017/065308
§ 371 (c)(1),
(2) Date: Dec. 21, 2018

(87) PCT Pub. No.: WO2017/220692
PCT Pub. Date: Dec. 28, 2017

(65) Prior Publication Data

US 2020/0031518 A1 Jan. 30, 2020

(30) Foreign Application Priority Data

Jun. 23, 2016 (EP) ..... 16175861

(51) Int. Cl.
*B65D 5/74* (2006.01)
*B65D 5/06* (2006.01)
(Continued)

(52) U.S. Cl.
CPC ..... *B65D 5/748* (2013.01); *B65D 5/064* (2013.01); *B65D 5/4266* (2013.01); *B65D 85/72* (2013.01)

(58) Field of Classification Search
CPC ..... B65D 5/064; B65D 5/068; B65D 5/748; B65D 5/4266; B65D 85/72; B65D 5/70;
(Continued)

(56) References Cited

U.S. PATENT DOCUMENTS 5,101,999 A * 4/1992 Robichaud ..... B65D 5/748 220/258.4
5,505,326 A * 4/1996 Junko ..... B65D 51/223 206/222
(Continued)

FOREIGN PATENT DOCUMENTS

EP 0557867 A1 1/1994
EP 1088764 A1 4/2001
(Continued)

OTHER PUBLICATIONS

Search Report and Written Opinion received in International Application No. PCT/EP2017/065308 dated Sep. 20, 2017.

*Primary Examiner* — J C Jacyna
(74) *Attorney, Agent, or Firm* — Knobbe, Martens, Olson & Bear, LLP

(57) ABSTRACT

A sheet packaging material for producing a sealed package of a pourable food product is disclosed. The packaging material may include at least one base layer for imparting stiffness to the sheet packaging material, at least one lamination layer applied to and covering said base layer, and a partially laminated opening zone. The opening zone may include a laminated cutting area having at least three longitudinal portions extending between the center and the periphery of the opening zone, and at least three removable portions adjacent to the laminated cutting area, each removable portion being located between two longitudinal portions and having a folding zone adjacent to the periphery of the opening zone. In use, the removable portions are partly detached from the packaging material by penetration of the
(Continued)

laminated cutting area prior to being folded at the folding zone to form an opening in the packaging material for pouring a food product from the package. A sealed package formed by folding and sealing the sheet packaging material is also disclosed.

16 Claims, 4 Drawing Sheets

(51) Int. Cl.
*B65D 5/42* (2006.01)
*B65D 85/72* (2006.01)

(58) Field of Classification Search
CPC ... B65D 5/73; B65D 5/74; B65D 5/76; B65D 5/78; B65D 5/80
USPC ..... 222/81–83.5, 88–91, 541.2–541.4, 541.6
See application file for complete search history.

(56) References Cited

U.S. PATENT DOCUMENTS 6,045,004 A * 4/2000 Elliott ..... B65D 47/0804 222/494
6,659,308 B1 * 12/2003 Kelder ..... B65D 51/226 222/494
7,036,683 B2 * 5/2006 Dubach ..... B65D 5/748 222/83
7,337,928 B2 * 3/2008 Jackman ..... B65D 47/10 222/494
7,484,641 B2 * 2/2009 Casale ..... B65D 5/748 222/83.5
7,703,642 B2 * 4/2010 Scott ..... B65D 47/127 222/522
8,372,328 B2 * 2/2013 Dubach ..... B29C 45/006 215/225
8,443,970 B2 * 5/2013 Coon ..... B65D 51/2835 206/222
9,650,174 B2 * 5/2017 Seelhofer ..... B65D 25/04
9,988,192 B2 * 6/2018 Canegallo ..... B65D 75/5883
10,542,946 B2 * 1/2020 Martin ..... A61B 1/00149
2007/0040009 A1 * 2/2007 Sase ..... B65D 5/748 229/125.14
2017/0021959 A1 * 1/2017 Benko ..... B65D 5/4266

FOREIGN PATENT DOCUMENTS

WO WO 2011/020634 A1 2/2011
WO WO 2015/079416 A1 6/2015

* cited by examiner

SHEET PACKAGING MATERIAL FOR PRODUCING SEALED PACKAGES OF POURABLE FOOD PRODUCTS

TECHNICAL FIELD

The present invention relates to a sheet packaging material for producing sealed packages of pourable food products.

BACKGROUND

Many pourable food products, such as fruit juice, UHT (ultra-high-temperature treated) milk, wine, tomato sauce, etc., are sold in packages made of sterilized packaging material.

The packaging material has a multilayer structure comprising a base layer, e.g. paper, covered on both sides with layers of heat-seal plastic material, e.g. polyethylene. In the case of aseptic packages for long-storage products the packaging material also comprises a layer of oxygen-barrier material, e.g. aluminium foil, which is superimposed on a layer of heat-seal plastic material, and is in turn covered with another layer of heat-seal plastic material forming the inner face of the package eventually contacting the food product.

Existing packages are normally provided with a detachable portion for opening the package. Using an opening device this portion is partly detached from the rest of the packaging material to free a pour opening through which the product is poured out. The detachable portion is formed on the packaging material prior to folding and sealing the packaging material to form the finished package. The detachable portion normally comprises a prelaminated hole. To form a prelaminated hole a circular hole is first formed solely through the base layer of the packaging material. The circular hole is then covered during lamination of the material with the layers of heat-seal plastic material and barrier material which adhere to one another at the hole thereby forming the prelaminated hole.

Previous efforts have focused on devising an effective, consistent method of opening prelaminated holes that achieves a clean cut about the edge of the pour-out opening without fraying to impair smooth pour-out of the food product.

WO 2011/020634 discloses a sheet packaging material for a sealed package comprising a food pour opening that is formed in use by cutting of an arc-shaped prelaminated strip located around the periphery of a foldable area of packaging material.

Nevertheless, there remains a need to provide improved packaging materials with pour openings that are cheaper to produce and easy to open while maintaining sufficient sealing of the food within the package prior to consumption.

SUMMARY OF THE INVENTION

According to one aspect of the present invention, there is provided a sheet packaging material for producing a sealed package of a pourable food product as claimed in claim 1.

According to another aspect of the present invention, there is provided a sealed package for a pourable food product as claimed in claim 6.

BRIEF DESCRIPTION OF THE DRAWINGS

Some preferred, non-limiting embodiments of the present invention will be described by way of example with reference to the accompanying drawings, in which.

DETAILED DESCRIPTION OF PREFERRED EMBODIMENTS

Figure 1:
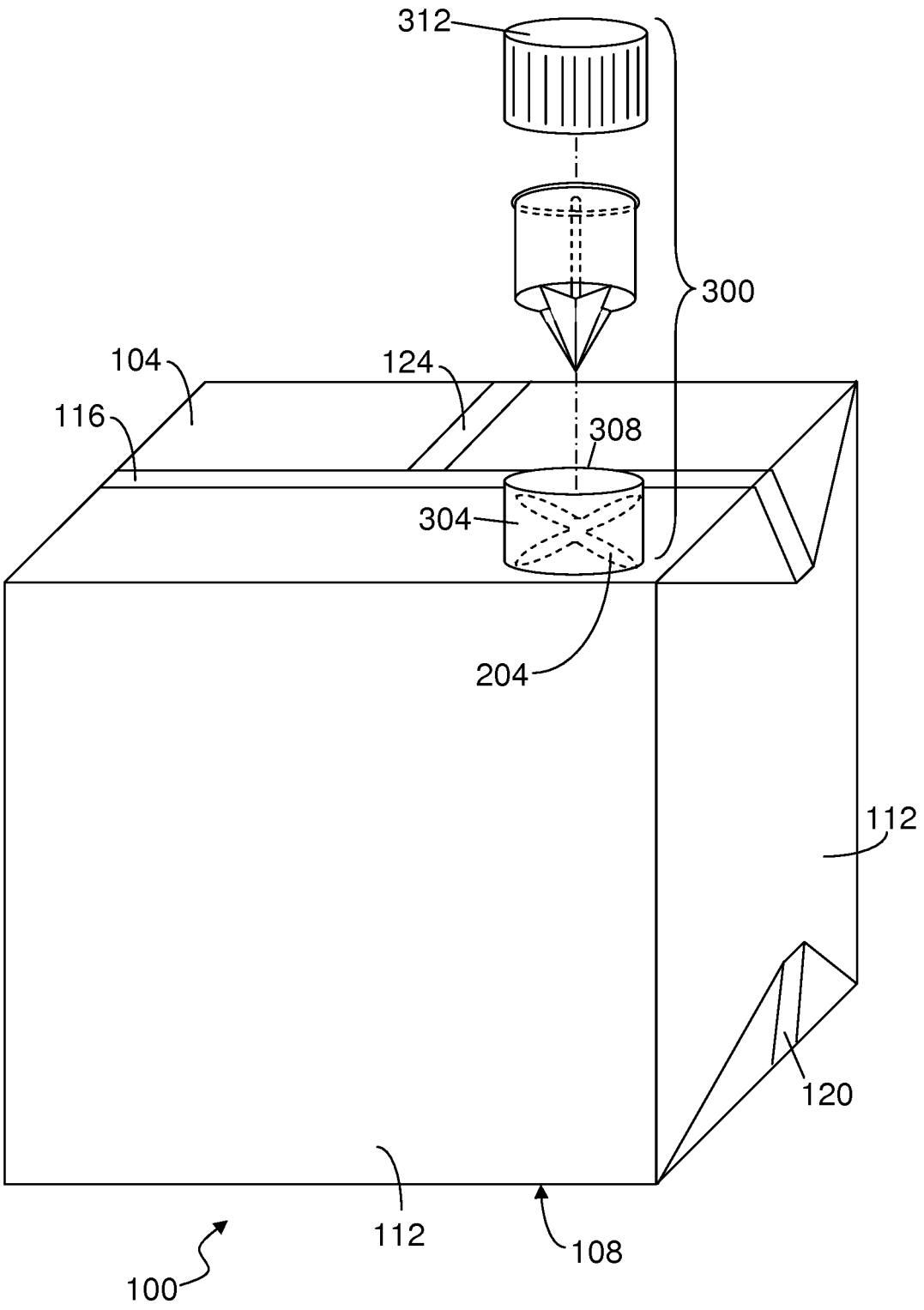
FIG. 1 is a partially exploded perspective view of a sealed package in accordance with an embodiment of the present invention.

FIG. 1 illustrates a sealed package 100 for a pourable food product. The sealed package 100 is formed by folding and sealing a sheet packaging material 200 shown in FIGS. 2A and 2B. Sealed package 100 comprises a quadrilateral top wall 104, a quadrilateral bottom wall 108, and four lateral walls 112 extending between top wall 104 and bottom wall 108. The top, bottom, and lateral walls 104, 108, and 112 may have a rectangular or square shape. After the sealed package is filled with a food product, folded, and sealed there is formed a top transverse sealing band 116 crossing top wall 104 along a centre line thereof, a bottom transverse sealing band 120 crossing bottom wall 108 and a longitudinal sealing band 124 extending perpendicularly between the top transverse sealing band 116 and the bottom transverse sealing band 120 along respective portions of the top and bottom walls 104 and 108 and along one of the lateral walls 112.

The package 100 also has a partially laminated opening zone 204 that will be described further below in regard to FIGS. 3A and 3B as well as a reclosable opening device 300 on top wall 104.

The reclosable opening device 300 comprises a frame 304 fitted about the partially laminated opening zone 204. The frame 304 has a pouring spout 308. A removable threaded cap 312 is screwable on and off the frame 304 to close and open the pouring spout 308 respectively, as desired. The opening device 300 also comprises a penetrator 340 located within the interior of the pouring spout 308. The penetrator 340 will be described further below with respect to FIG. 4A.

The reclosable opening device 300 is made of plastic. The frame 304 is applied to the package 100 by conventional fastening systems such as adhesives, micro-flame, electric-current-induction, ultrasound, laser, or other heat-sealing techniques.

Figure 2A:
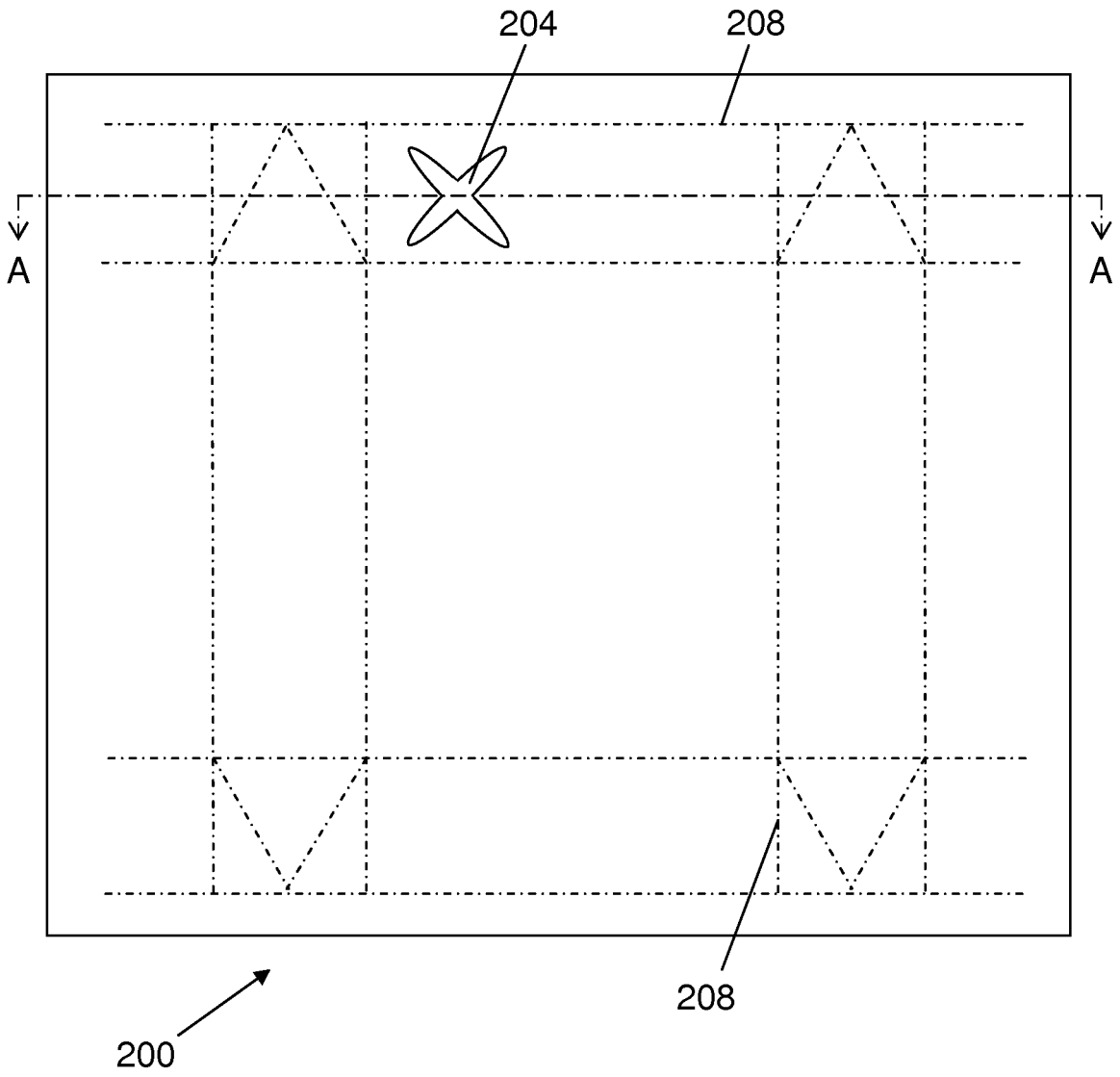
FIG. 2A depicts a sheet packaging material for producing the sealed package in FIG. 1.

FIG. 2A depicts a sheet packaging material 200 for producing the sealed package 100 in FIG. 1 by folding of the material 200 about the crease lines 208. The crease lines 208 define in a known manner the top, bottom, and lateral walls 104, 108, and 112 of sealed package 100. Other suitable crease line patterns for use in the present invention are disclosed in WO 2011/020634 and WO 2015/169656 for example.

Figure 2B:
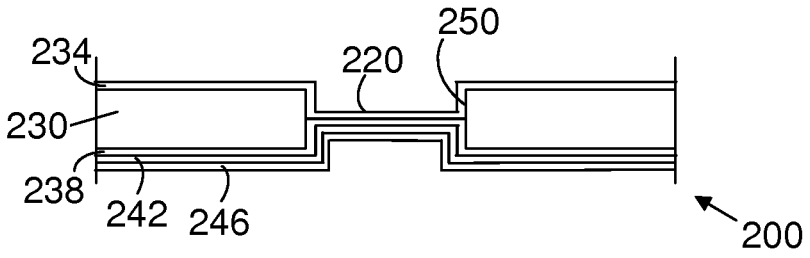
FIG. 2B is a cross-sectional side view of the sheet packaging material in FIG. 2A along A-A showing its multilayer structure.

The packaging material 200 from which sealed package 100 is made has a multilayer structure as illustrated in FIG. 2B comprising a base layer 230, e.g. of paper, for stiffness, and a number of lamination layers 234, 238, 242, and 246 covering both sides of base layer 230. The lamination layers 234, 238, 242, and 246 comprise a layer 242 of oxygen-barrier material, e.g. an aluminum foil, and a number of layers 234, 238, and 246 of heat-seal plastic material covering both sides of both base layer 230 and oxygen barrier layer 242. Layer 246 eventually forms the inside of package 100. Next to the innermost layer 246 is the oxygen barrier material 242 and next to layer 242 is another layer of heat-seal plastic material 238. The base layer 230 is covered by heat-seal plastic material layers 238 and 234. The innermost layer 246 of heat-seal plastic material contacting the food product, in use, may, for example, be made of strong, in particular, high-stretch, metallocene-catalyzed, low-linear-density (LLD) polyethylene. Layers 234, 238, and 246 of heat-seal plastic material are preferably laminated on the base layer 230 in a melted state, with successive cooling.

The base layer 230 may e.g. be carton, paper, paperboard, cardboard, foam, or any other cellulose-based layer suitable for forming a bulk or core layer of a laminated packaging material. The outer layer 234 is intended to protect the base layer towards liquids and dirt, as well as to provide heat sealability properties in a subsequent filling and packaging process. An inner side of the base layer 230 is covered with a similar bonding layer 238 of a thermoplastic polymer, such as conventionally LDPE which is used to laminate, i.e. bind together, a thin, sensitive, layer comprising a gas barrier material, such as for example a thin foil of aluminium 242, to the bulk layer 230. In order to avoid contact between the enclosed product and the barrier material or the aluminium foil 242, the aluminium foil is covered by a polymer layer 246.

In a package formed using a laminated packaging material 200 that includes one of the film laminate 234, 246 embodiments described above, the polymer film 246 of the film laminate is closer to the food product than the substrate, or oxygen barrier material 242. In other words, the polymer film 246 forms the inner side of the package. The polymer film 246 thus needs to be sealable in order to allow heat sealing of two adjacent portions of a laminated packaging material 200. The polymer film 246 also needs to be liquid-tight for ensuring stiffness and rigidity of a bulk layer 230 of the laminated packaging material 200.

Hence, an innermost layer 246 of the laminated packaging material 200 is a heat-sealable layer. An example of a heat-sealable layer is a heat-sealable polyolefin polymer which is applied as a layer to be directed towards the inside of the package, i.e. in direct contact with the food product. The innermost layer may suitably be a heat-sealable polymer such as a polyethylene (PE) polymer of the low density type, selected from the group consisting of LDPE, linear LDPE (LLDPE), Very Low Density PE (VLDPE), Ultra Low Density PE (ULDPE) or metallocene catalyst manufactured LLDPE (mLLDPE) and blends of two or more thereof. Depending on the type of packaging containers produced from the laminated packaging material, heat-sealable innermost layers of high density polyethylene (HDPE), polypropylene (PP) or propylene co- or ter-polymers are also conceivable, as long as they are compatible with and achieve the desired effect in combination with other components of the laminated packaging material.

Suitable examples to be used as innermost layers are blends between LDPE and mLLDPE (e.g. 50/50, 40/60, 60/40, 30/70, 70/30, 20/80, 80/20, 10/90m 90/10, 0/100, 100/0 weight % blend ratios), such as LDPE of extrusion grade, for example having a melt flow index (as determined in accordance with ASTM D1238, 190° C./2.16 kg) of 2-20, such as 2-12, such as 2-7, such as 2-6 and a density (as determined in accordance with ISO 1183, method D) of 914-922 kg/m3, such as 915-920 kg/m3. Examples of mLLDPEs suitable for use in aspects and embodiments described herein have a density less than 0.922 kg/cm3 and a melt flow index (MFI) of 15-25 at 190° C. and 2.16 kg (ASTM 1278). A thickness of the innermost layer 246 of the laminated packaging material 10 is for example between 5 μm-50 μm, such as 10 μm-30 μm, such as 15 μm-25 μm, such as 17 μm-25 μm.

A portion is cut or punched out of the base layer 230 during manufacture of the packaging material 200 to provide a slot 250. Lamination layers 234 and 238 which extend along opposite faces of base layer 230 are sealed together during lamination through slot 250 to provide the laminated cutting area 220 of opening zone 204 which will be described further below.

Figure 3A:
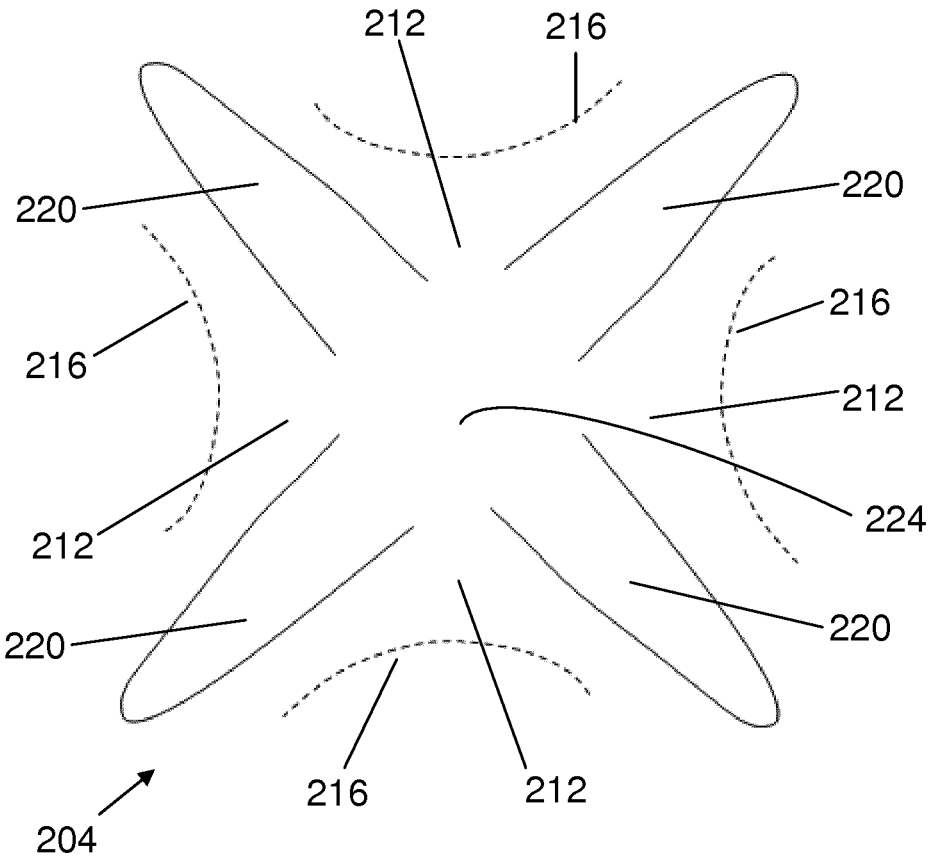
FIG. 3A illustrates the a partially laminated opening zone on the sealed package in FIG. 1 and the sheet packaging material in FIG. 2A-2B.
Figure 3B:
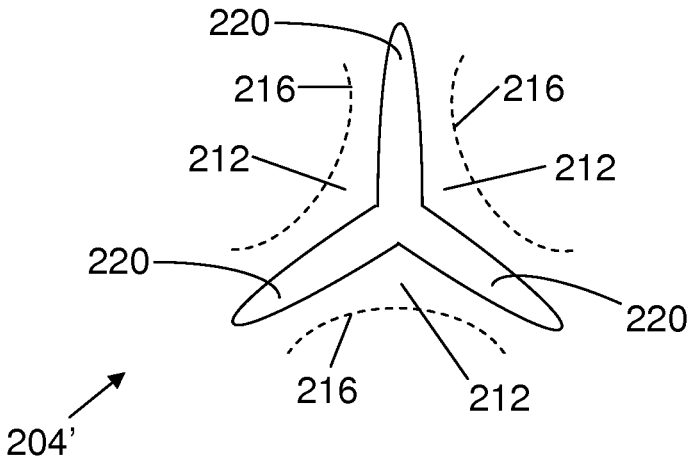
FIG. 3B illustrates an alternative partially laminated opening zone suitable for the sealed package in FIG. 1 and the sheet packaging material in FIG. 2A-2B.

FIGS. 3A and 3B illustrate partially laminated opening zones 204 and 204' for use on the packaging material 200 and sealed package 100.

The partially laminated opening zone 204 in FIG. 3A comprises a laminated cutting area 220, 224 and four removable portions 212. The laminated cutting area 220, 224 has a circular portion 224 located in the centre of the opening zone 204 and four longitudinal portions 220 extending between the circular portion 224 and the periphery of the opening zone 204. However, it is not necessary to include the circular portion 224 and in that case the four longitudinal portions 220 extend between the centre and the periphery of the opening zone 204. Further, the portion 224 may not be arranged centrally but instead radially offset within the opening zone 204. Additionally the shape of the portion 224 may not necessarily be circular; other shapes such as rectangular, triangular, elliptic, etc. are also possible.

The four longitudinal portions 220 are spaced apart from each other at optionally equal angles about the centre of the partially laminated opening zone 204. Each removable portion 212 is located between two longitudinal portions 220 in a position opposing another removable portion 212. The removable portions 212 have a folding zone 216 adjacent to the periphery of the opening zone 204 about which the removable portions 212 are folded towards the interior of the sealed package 100 upon opening as will be described below.

FIG. 3B shows an alternative partially laminated opening zone 204'. The opening zone 204' has a laminated cutting area comprising three longitudinal portions 220 extending between the centre and the periphery of the opening zone 204' as well as three removable portions 212 located in between the longitudinal portions 220. Again, the removable portions have a folding zone 216 adjacent to the periphery of the opening zone 234. As for the embodiment described with reference to FIG. 3A the longitudinal portions 220 may meet in a central portion, which for some embodiments not necessarily need to be provided at the center of the opening zone 204'.

Figure 4A:
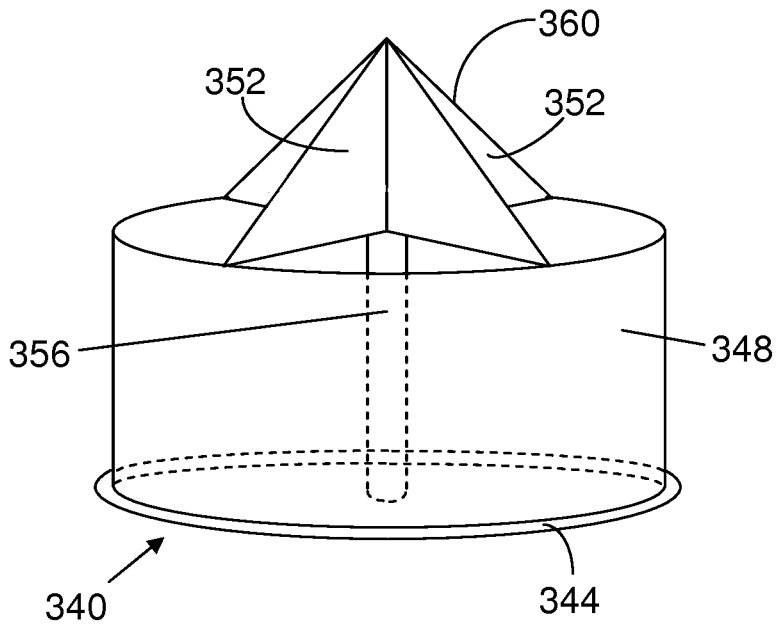
FIG. 4A shows a penetrator according to one embodiment of the invention for use with the partially laminated opening zone in FIG. 3A.
Figure 4B:
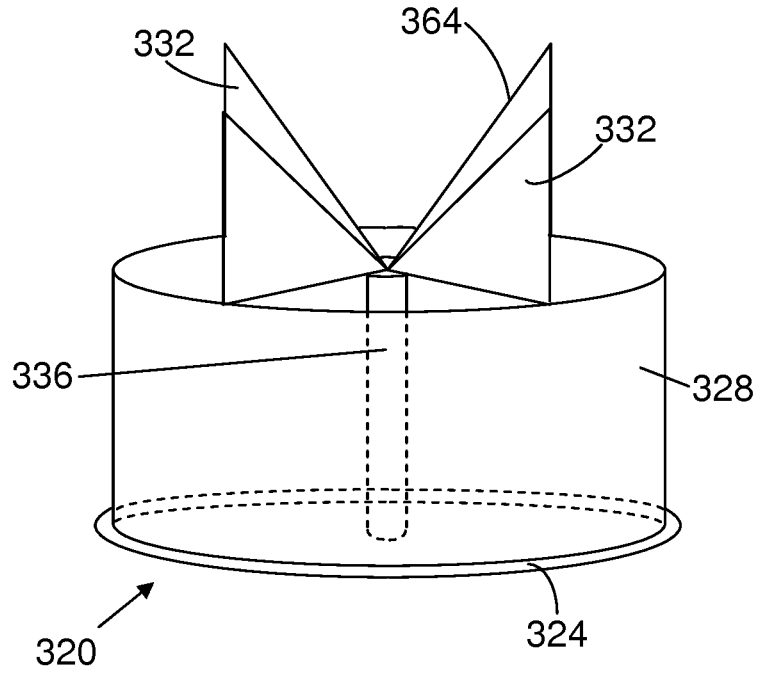
FIG. 4B shows a penetrator according to another embodiment of the invention for use with the partially laminated opening zone in FIG. 3A.

FIGS. 4A and 4B depict penetrators 340 and 320 respectively that are located within the pouring spout 308 of opening device 300. Both penetrators 320 and 340 are suitable for use with the partially laminated opening zone 204 in FIG. 3A. Each penetrator 320, 340 has four penetrating members 332, 352 which are located proximally to the partially laminated opening zone 204 prior to opening of package 100. In this proximal location the penetrating members 332, 352 extend between the centre and the periphery of the opening zone 204 to correspond or align with the laminated cutting area 220, 224. The penetrating members 332, 352 are triangular-shaped plates each having a slanted edge 360, 364 between the peripheral cylinder 328, 348 and the central shaft 336, 356. As illustrated in FIG. 4A, edge 360 slants proximally towards the partially laminated opening zone (not shown) from the cylinder 348 to the shaft 356. In contrast, and as depicted in FIG. 4B, edge 364 slants distally from the partially laminated opening zone from the cylinder 328 to the shaft 336.

Each penetrator 320 and 340 also has a cylinder 328, 348 extending distally from the penetrating members 332, 352 and around the periphery of the penetrators 320, 340. A shaft 336, 356 also extends distally from the penetrating members 332, 352 but along the central longitudinal axis of the penetrators 320, 340. As is evident from FIGS. 4A and 4B, the penetrating members 332, 352 are spaced apart from each other at equal angles about the axis of the shaft 336, 356. The penetrators 320 and 340 have an annular flange 324, 344 at the end of the cylinder 328, 348 distal to the penetrating members 332, 352. The distal direction as used above is intended to mean extending further away from the opening zone 204 and the package 100.

Penetrators 320 and 340 are made from plastic and preferably in one piece by injection molding.

The sealed package 100 is opened as follows. During manufacturing of a filled package, the frame 304 is attached to the package thus covering, or extending away from, the sealed opening zone 204. As explained above the frame 204 is preferably provided with external threads for guiding the cap 312 during assembly.

The cap 312, having corresponding internal threads, is subsequently engaged with the frame 304 by a screwing action. The penetrator 320, 340 is arranged within the cap 312 and is allowed to rotate relative the cap 312 during the screwing action. However, the penetrator 320, 340 is guided in its axial direction relative the cap 312. For this the penetrator 320, 340 may have external threads engaging with internal threads of the frame 304. The threads of the penetrator 320, 340 and the frame 304 may preferably be configured in an opposite direction compared to the threads of the cap 312 such that when screwing the cap 312 onto the frame 304 the penetrator 320, 340 will be lifted upwards. This means that when the cap 312 is screwed onto the frame 302 the penetrator 320, 340 will move axially away from the opening zone 204, but remain in its angular position relative the laminated cutting area 220, 224. For this purpose alignment of the penetrating members 332, 352 relative the laminated cutting area 220, 224 may be performed prior to engaging the cap 312 with the frame 204.

When screwing the cap 312 onto the frame 304, which is preferably made automatically during package manufacturing, the penetrator 320, 340 will be positioned away from the laminated cutting area 220, 224. The package will thus be sealed.

When the package is opened, the cap 312 is unscrewed from the frame 304. Upon this the penetrator 320, 340 will exhibit an axial pressure downwards to push penetrating members 332, 352 through the laminated cutting area 220, 224. This is due to the fact that the penetrator 320, 340 will move axially downwards when the cap 312 moves axially upwards. Penetrating the laminated cutting area 220, 224 also partly detaches removable portions 212 from the packaging material 200. Application of pressure is continued after the laminated cutting area 220, 224 has been pierced by penetrating members 332, 352 so that the cylinder 328, 348 comes into contact with, and inwardly folds, the removable portions 212 about the folding zones 216. The applied pressure is then discontinued upon finishing unscrewing the cap 312. A large proportion of the penetrator 320, 340 is then contained below top wall 104 within the interior of the package 100. The annular flange 324, 344 not only imparts strength to the penetrator 320, 340 but also sits on or slightly above the top wall 104 to prevent the penetrator 320, 340 from completely falling into the food product within the package 100.

The penetrator 320, 340 stays in its position upon removing the unscrewed cap 312. Hence the penetrator 320, 340 will be disengaged from the cap 312 and remain its position relative the frame 304 such that the penetrator 320, 340 is fixed to the frame 304 along with the removal of the cap 312.

The food product may then be poured, optionally through channels roughly bounded by the penetrating members 332, 352 and the partly detached removable portions 212. If desired, the cap 312 may be screwed back onto the frame 304 to close the pouring spout 308 so that the food product can be kept in the package 100 for consumption later.

The opening action described above is called a one-step opening, since penetration is performed simultaneously as the cap 312 is unscrewed.

In another embodiment the penetrator 320, 340 may be separated from the interior of the cap 312, however still enclosed within the cap 312. Upon unscrewing the cap 312 the customer will have access to the penetrator 320, 340. The penetrator 320, 340 is thereafter manually pushed through the laminated cutting area 220, 224 in order to open the package. This opening action is usually called a two-step opening since unscrewing of the cap 312 and penetration are two separate and consecutive steps. The two-step opening may in some cases be preferred since the user may inspect the laminated cutting area 220, 224 before penetration, thus ensuring seal integrity.

The laminated cutting area 220, 224 of packaging material 200 has a smaller surface area than existing circular or round laminated areas which allows for a reduction in the amount of material that is cut or punched out of the base layer 230 during manufacturing. This decreases the production losses (less base layer 230 to discard) and lowers the manufacturing cost while the package 100 remains easy to open with no detrimental impact on the food preservation and pouring efficiency. The relatively small laminated area of the partially laminated opening zone 204, 234 also results in a package 100 with a lower oxygen transmission rate (OTR) as less of the package interior is potentially exposed to the outer environment.

The penetrator 320, 340 allows for fast and efficient opening of the package 100 in one swift vertical movement via penetration of laminated cutting area 220, 224 and folding of removable portions 212.

The invention claimed is:

1. A sheet packaging material for producing a sealed package of a pourable food product, the sheet packaging material comprising:

a base layer, the base layer imparting stiffness to the sheet packaging material; a lamination layer covering the base layer; and a partially laminated opening zone comprising:

a laminated cutting area, the laminated cutting area having at least three longitudinal portions extending from a central portion towards a periphery of the partially laminated opening zone;

at least three removable portions adjacent to the laminated cutting area, each removable portion located between at least two longitudinal portions and comprising a folding zone adjacent to the periphery of the partially laminated opening zone;

wherein the base layer, the lamination layer, and the partially laminated opening zone are configured to fold and seal to form a sealed package; and wherein the at least three removable portions are configured to form an opening in the sheet packaging material, the opening configured for pouring a food product when the at least three removable portions are partly detached from the sheet packaging material by a penetrator penetrating the laminated cutting area prior to the at least three removable portions being folded at each folding zone toward the interior of the sealed package, the opening configured to readily allow food product flow in the absence of increased product pressure on the package.

2. The sheet packaging material of claim 1, wherein the laminated cutting area has at least four longitudinal portions.

3. The sheet packaging material of claim 1, wherein the laminated cutting area further comprises a circular portion located in the center of the partially laminated opening zone, such that the at least three longitudinal portions extend between the circular portion and the periphery of the partially laminated opening zone.

4. The sheet packaging material of claim 1, wherein the at least three longitudinal portions are spaced apart from each other at equal angles about the center of the partially laminated opening zone.

5. The sheet packaging material of claim 1, further comprising a plurality of fold lines.

6. A sealed package for a pourable food product, the sealed package comprising:

a sheet packaging material folded and sealed to form a sealed package, the sheet packaging material comprising:

a base layer, the base layer configured to impart stiffness to the sheet packaging material;

a lamination layer covering the base layer;

a partially laminated opening zone;

a reclosable opening device comprising:

a frame fitted about a partially laminated opening zone and comprising a pouring spout;

a removable threaded cap, the removable threaded cap configured to close the pouring spout by screwing onto the frame; and a penetrator located within the interior of the pouring spout, the penetrator comprising:

at least three penetrating members located proximally to the partially laminated opening zone, the at least three penetrating members extending from a central portion and towards the periphery of the partially laminated opening zone to align with a laminated cutting area;

a cylinder extending distally from the at least three penetrating members around the periphery of the penetrator;

a shaft extending distally from the at least three penetrating members at the center of the penetrator; and wherein the penetrator is configured such that when pressure is applied to the shaft, the penetrating members penetrate the laminated cutting area and the cylinder folds the removable portions toward the interior of the sealed package to open the sealed package, the opening configured to readily allow food product flow in the absence of increased product pressure on the sealed package.

7. The sealed package of claim 6, further comprising a fourth penetrating members.

8. The sealed package of claim 6, wherein the at least three penetrating members comprise triangular-shaped plates comprising a slanted edge between the cylinder and the shaft, the slanted edge slanting proximally to the partially laminated opening zone from the cylinder to the shaft.

9. The sealed package of claim 6, wherein the at least three penetrating members are triangular-shaped plates having a slanted edge between the cylinder and the shaft, the slanted edge slanting distally from the partially laminated opening zone from the cylinder to the shaft.

10. The sealed package of claim 6, wherein the at least three penetrating members are spaced apart from each other at equal angles about the shaft.

11. The sealed package of claim 6, wherein the penetrator further comprises an annular flange at the end of the cylinder distal to the penetrating members.

12. The sheeting packaging material of claim 1, wherein the opening zone further comprises a frame, the frame configured to allow the penetrator to penetrate the laminated cutting area.

13. The sheet packaging material of claim 12, wherein the frame comprises threads configured to seal to a threaded cap.

14. The sealed package of claim 6, wherein the frame comprises threads configured to seal to the threaded cap.

15. The packaging material of claim 1, wherein the base layer comprises foil.

16. The packaging material of claim 1, wherein the lamination layer comprises foil.

* * * * *